US007926436B2

(12) United States Patent
Boatman et al.

(10) Patent No.: US 7,926,436 B2
(45) Date of Patent: Apr. 19, 2011

(54) DUAL AXIS CHAIN SUPPORT WITH CHAIN PULL THROUGH

(75) Inventors: L. Terry Boatman, Spice Wood, TX (US); Stephen P. Lindblade, Waller, TX (US)

(73) Assignee: SOFEC Inc., Houston, TX (US)

( * ) Notice: Subject to any disclaimer, the term of this patent is extended or adjusted under 35 U.S.C. 154(b) by 346 days.

(21) Appl. No.: 12/321,051

(22) Filed: Jan. 15, 2009

(65) Prior Publication Data

US 2010/0175604 A1 Jul. 15, 2010

(51) Int. Cl.
*B63B 21/00* (2006.01)

(52) U.S. Cl. ..... 114/230.2; 114/200

(58) Field of Classification Search ..... 114/179, 114/180, 181, 199, 200, 210, 230.2, 293
See application file for complete search history.

(56) References Cited

U.S. PATENT DOCUMENTS

| | | | | |
|---|---|---|---|---|
| 3,289,626 | A | 12/1966 | Petrie | |
| 3,557,737 | A | 1/1971 | Smulders | |
| 5,441,008 | A | 8/1995 | Lange | |
| 5,842,434 | A | 12/1998 | Lange | |
| 5,845,893 | A * | 12/1998 | Groves | 114/293 |
| 6,435,121 | B2 | 8/2002 | Siring | |
| 6,439,146 | B2 | 8/2002 | Seaman | |
| 6,663,320 | B1 | 12/2003 | Braud | |
| 6,925,890 | B2 | 8/2005 | Fontenot | |
| 7,104,214 | B2 | 9/2006 | Niebur | |
| 7,325,508 | B2 * | 2/2008 | Boatman et al. | 114/230.2 |
| 7,392,757 | B2 | 7/2008 | Niebur | |

FOREIGN PATENT DOCUMENTS

GB 2351058 12/2000

OTHER PUBLICATIONS

Jean, P., Goessens, K., and L'Hostis, D., Failure of Chains by Bending of Deepwater Mooring Systems, OTC 17238, Offshore Technology Conference, Houston TX, May 2005.

* cited by examiner

*Primary Examiner* — Lars A Olson
(74) *Attorney, Agent, or Firm* — Gary L. Bush; Andrews Kurth LLP

(57) ABSTRACT

A chain support 11, hinged on two perpendicular axes 5, 6 which allows chain movement in two perpendicular planes. The chain support provides an improved arrangement to allow chain 4 to be pulled through the center of the apparatus to a desired length after which the chain is removably secured to the chain support.

9 Claims, 6 Drawing Sheets

DUAL AXIS CHAIN SUPPORT WITH CHAIN PULL THROUGH

BACKGROUND OF THE INVENTION

1. Field of the Invention

This invention relates generally to mooring systems for offshore structures such as platforms and vessels and in particular, to a device which supports the mooring chain in such systems.

2. Description of the Prior Art

FIG. 1 illustrates a prior art mooring line connector illustrated in U.S. Pat. No. 6,663,320. This known connector allows the mooring line to rotate in two perpendicular planes relative to the offshore structure to which it is attached. The mooring line is connected using a rod and a latch mechanism. Adjustment of the length of the mooring line, which is often desired before and sometimes after installation of the mooring line, disadvantageously must take place before the rod is connected, most likely on board of another vessel.

FIG. 2 illustrates a prior art mooring line connector from UK Patent Application GB2351058. The chain stopper provides two axes of rotation, advantageously providing reduced chain wear, but it is not designed to minimize so called out-of-plain bending, which occurs when the chain is under tension and one chain link (the captive link) is fixed by the chain stopper while the adjacent link below the captive link is allowed to rotate relative to the captive link. Also, during chain installation and tensioning, an uplift force is produced in the connector that must be resolved by bending the line of chain or by other means.

3. Identification of Objects of the Invention

A primary object of this invention is to provide a chain support in which fatigue damage due to out-of-plane bending is reduced.

Another object of this invention is to provide a chain support that allows rotation about two perpendicular axes whereby the maximum total rotation about the first axis is at least 90 degrees and the rotation about the second axis is ±15 degrees.

Another object of this invention is to provide a chain support that allows the upper end of the mooring line to be pulled up vertically through the assembly while at the same time allowing large vertical angle variations of the lower end of the mooring, without inducing objectionable vertical or lateral misalignment of the assembly with the mooring line.

Another object of this invention is to provide a chain support that allows adjustment of the mooring line length at any time by pulling in or letting out chain links with the capability of latching into every other chain link.

Another object of this invention is to provide a chain support with an arrangement of components that minimizes the overall width of the assembly.

SUMMARY OF THE INVENTION

The objects identified above, along with other features and advantages result from providing a chain support with two axes of rotation and an elongated hawse pipe. The longer length of the hawse pipe ensures that small angles between the last captive chain link and the first free chain link result in a rotation of the hawse pipe about either axis of rotation.

An elongated hawse pipe is pivotally connected to a structure by a hollow trunnion block. The trunnion block is fitted with two pairs of trunnions, providing two axes of rotation that are oriented perpendicularly to each other. By routing the chain through the trunnion block, the hawse pipe remains aligned with the chain below the hawse pipe when the chain is pulled up through the connector. The second pair of trunnions is arranged below the first pair of trunnions so that the overall width of the trunnion block is comparable to that of a conventional single-axis trunnion block. This arrangement provides several advantages including a smaller footprint and interchangeability with existing single-axis chain supports.

A chain latch for locking off the chain is incorporated into the lower end of the elongated hawse pipe. In most existing chain support designs, the chain latch is mounted on the upper end of the hawse pipe where it is easily accessible during the initial tensioning of the mooring chain. By placing the chain latch at the lower end of the elongated hawse pipe and supporting the free end of the chain that is extending above the chain support, the chain inside the trunnion block is slack and does not impede the rotations of the hawse pipe around the lower pair of trunnions.

The length of the hawse pipe is chosen such that even very small angles between the captive chain link on the chain latch and the first free chain link below the captive link generate enough torque to rotate the hawse pipe around either one of the axes. This ensures that the bending stresses in the first free link are kept at low levels and the accrual of fatigue damage can be controlled.

DESCRIPTION OF THE PREFERRED EMBODIMENT

Figure 1:
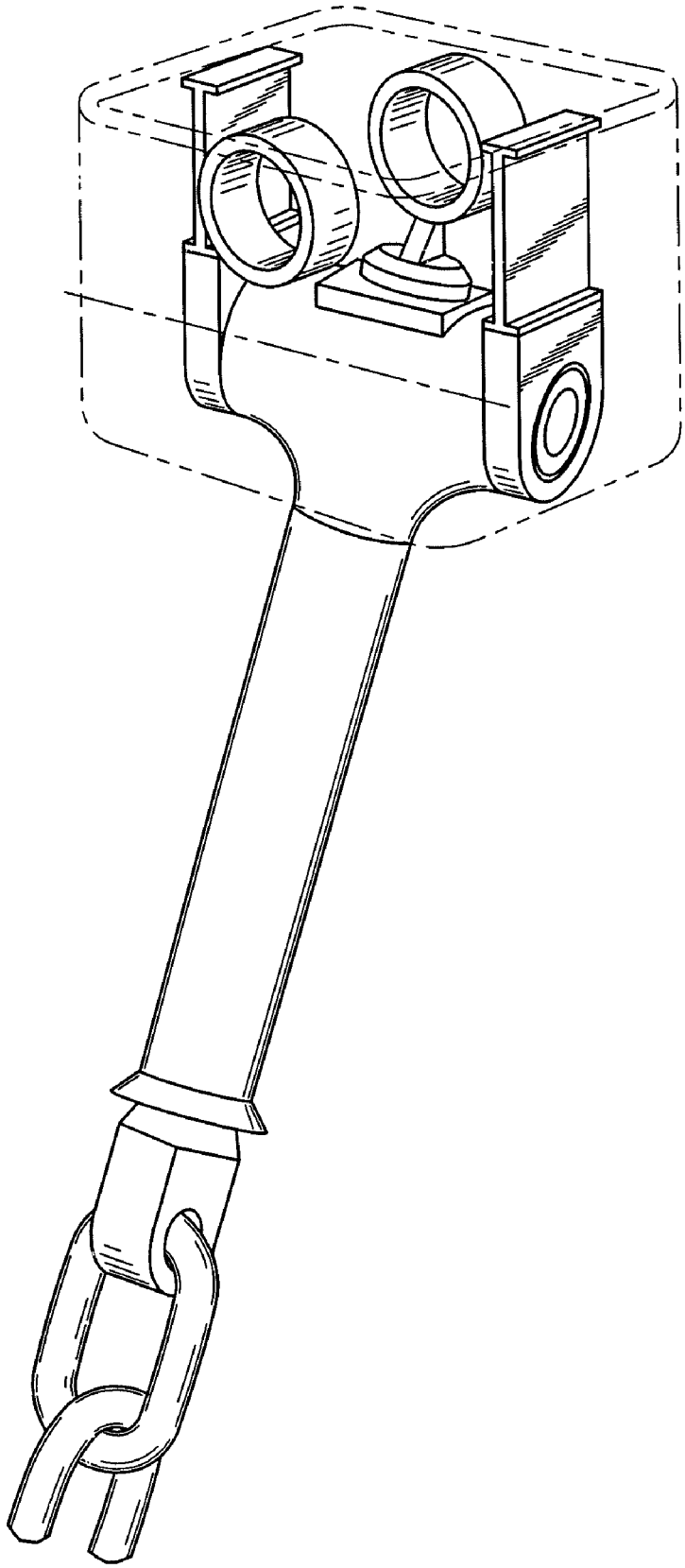
Fig. 1 (Prior Art)
FIG. 1 shows a prior art mooring line connector with two axes of rotation where the connection is established by latching a rod into a tube.
Figure 2:
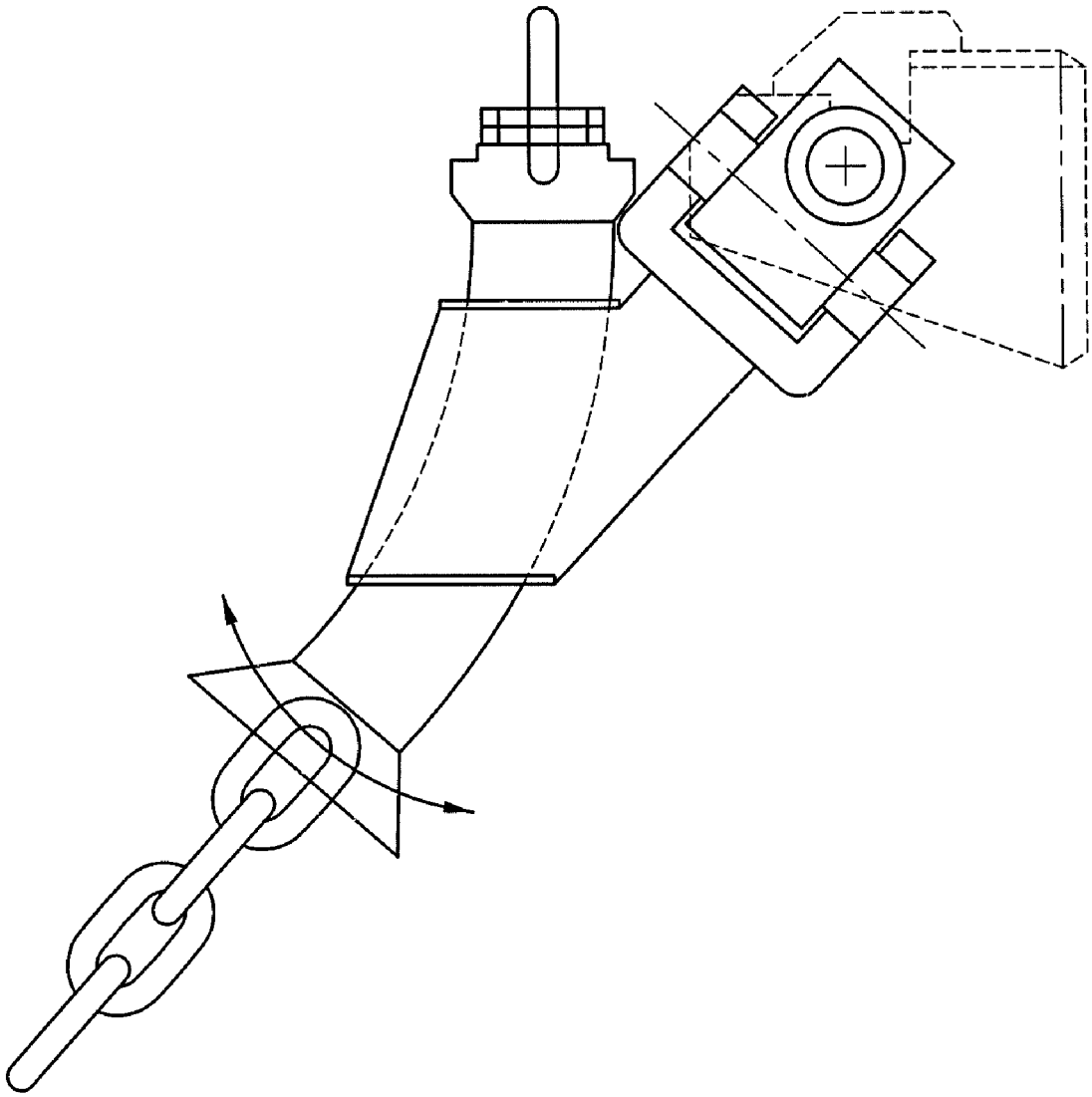
Fig. 2 (Prior Art)
FIG. 2 shows a prior art mooring line connector with two axes of rotation where the mooring line length can be adjusted by pulling up outside of the universal joint assembly.
Figure 3:
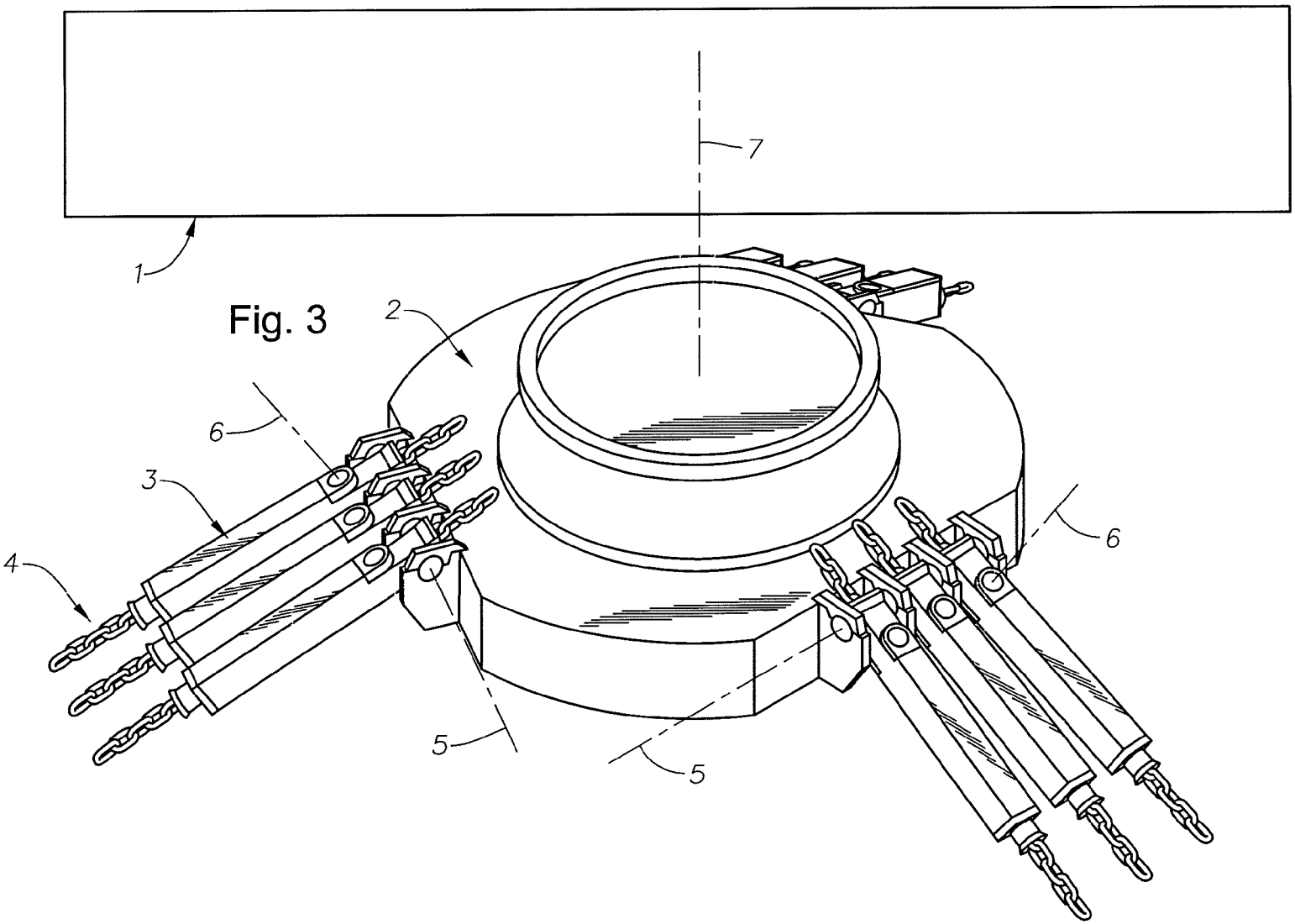
FIG. 3 shows a mooring system including nine mooring lines, arranged in three groups of three with each mooring line connected to the non-rotating part of the single point mooring system.

FIG. 3 shows a single point mooring system for a vessel 1 that is moored with nine mooring lines or chains 4. A chaintable 2 is rotatably connected to the vessel 1 and to the mooring lines 4. The vessel is free to weathervane around a vertical axis 7. The upper end of each mooring line includes a section of chain 4 which is connected to the chaintable 2 using a dual-axis chain stopper 3 according to the invention. Each chainstopper 3 allows rotation of the chain around a generally horizontal first axis 5 and a generally vertical second axis 6.

Figure 4:
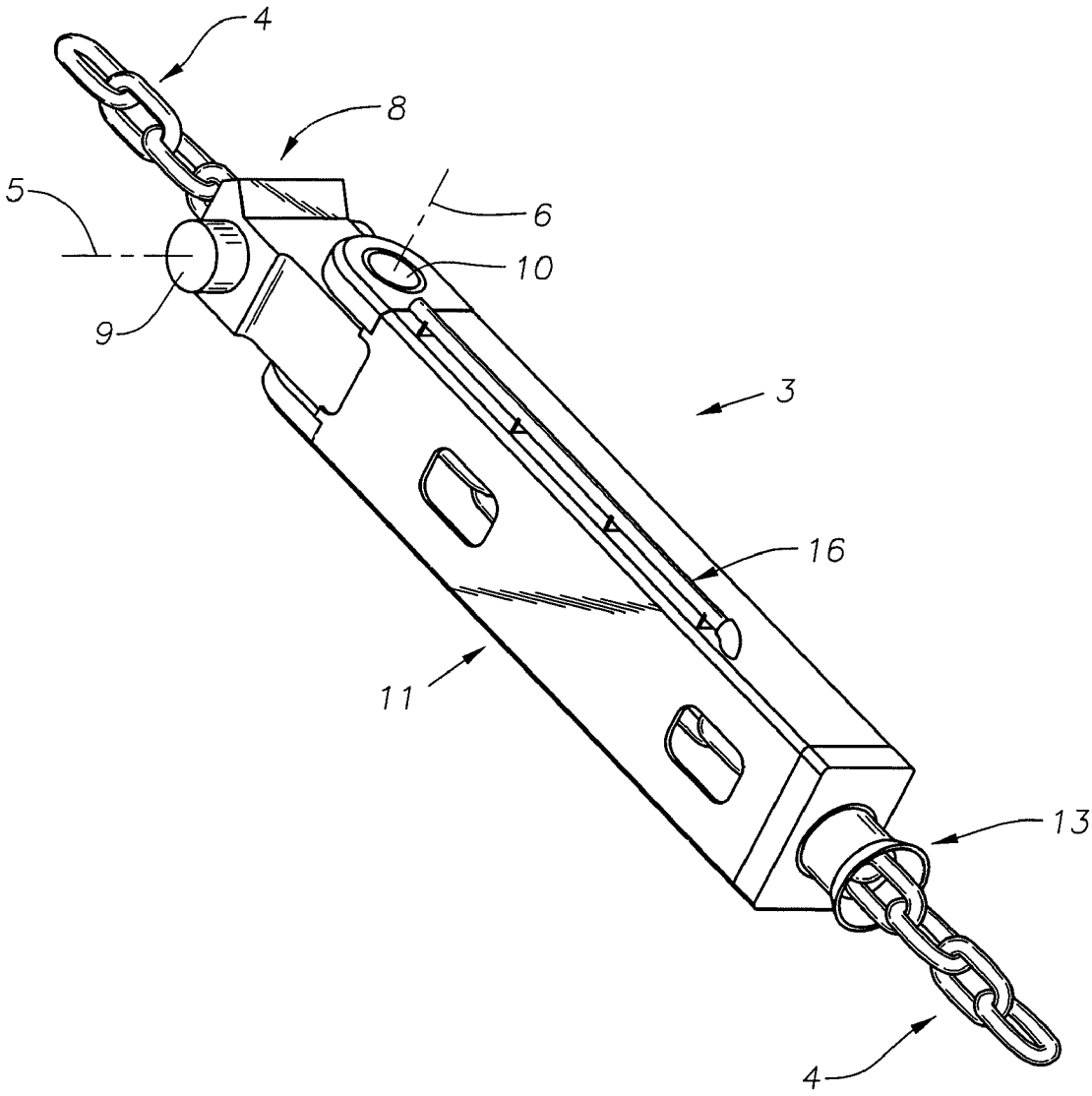
FIG. 4 shows a perspective view of the chain support with the chain extending from both ends of the chain stopper.

FIG. 4 shows a perspective view of the chain support 3. The mooring chain 4 is pulled through guide mouth 13 and through the interior of an elongated hollow housing 11. The chain 4 exits the chain support 3 through trunnion block 8. Since the direction of pull is often different from the orientation of the housing 11, the trunnion block 8 is fitted with a guide radius 17. (See FIG. 5) The guide radius 17 includes a groove to distribute the load over the chain links thus preventing unwanted bending stresses in the chain links. The elongated hollow housing 11 is rotatably connected to trunnion block 8 with a pair of lower trunnions 10 and a clevis 12. Low friction, self-lubricating bushings (not shown) are disposed between the pair of lower trunnions 10 and the clevis 12. The trunnion block 8 is connected to the chaintable 2 through a pair of upper trunnions 9. The trunnions 9 are connected to structure 2 with bearing blocks and caps and low friction self-lubricating bushings placed between the upper trunnions 9 and said blocks and caps.

The chain 4 enters the hollow housing 11 through a lower guide mouth 13. A latch mechanism 14 is mounted inside the housing 11 to latch the chain 4 once the desired amount of chain has been pulled through the chainstopper. If there is a need to let out chain 4, a cable running through pipe 16 and attached to the latch mechanism is provided to keep the latch in the open position so that the chain 4 can be lowered.

Figure 5:
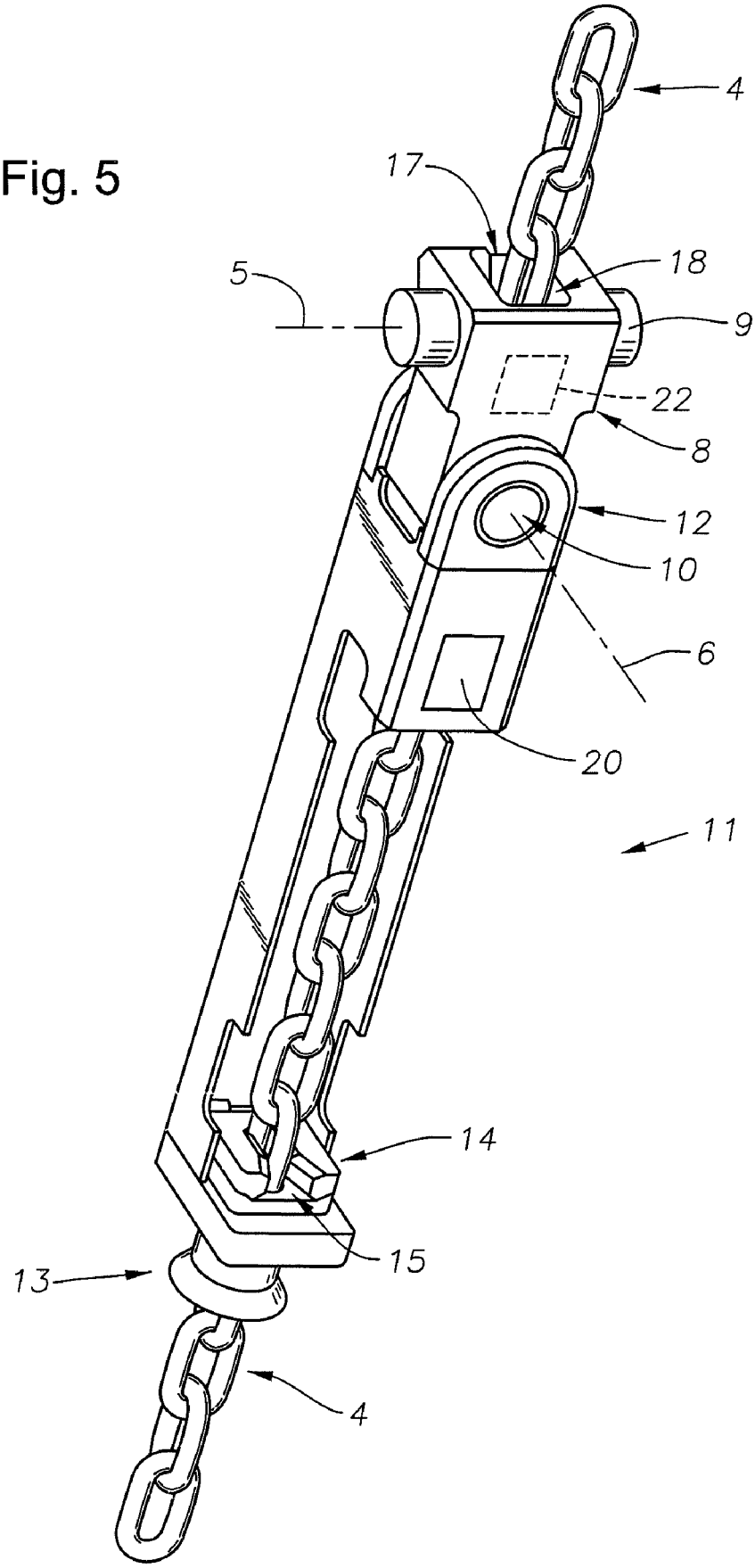
FIG. 5 shows another perspective view of the chain support with part of the housing removed for clarity to show some of the inner parts.
Figure 6:
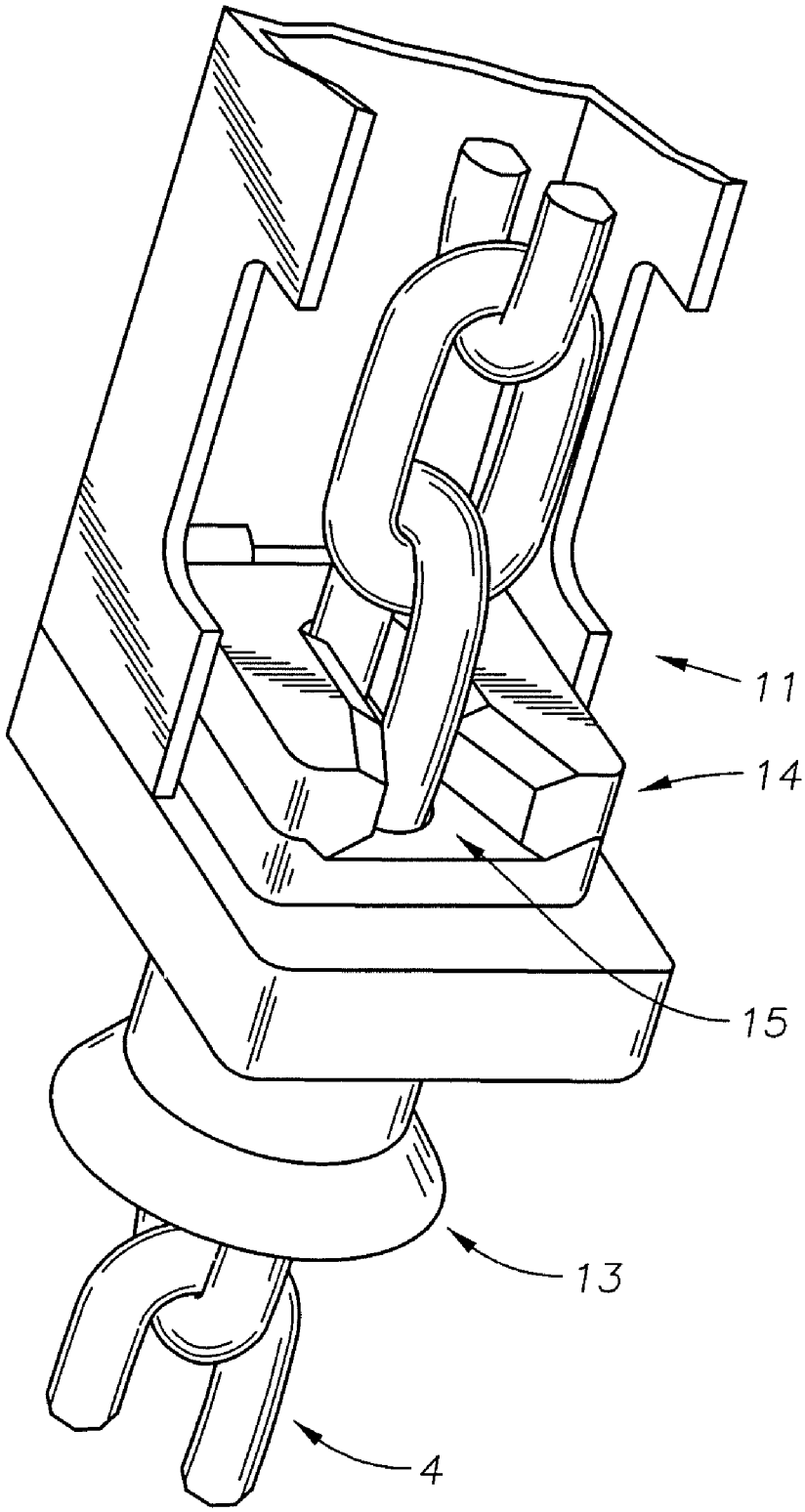
FIG. 6 is an enlarged view of the lower end of the housing.

FIG. 5 shows another perspective view of the chain support 3 with part of the hollow housing 11 removed for clarity. As shown in the enlargement of FIG. 6 the latch 14 according to a preferred embodiment includes a hinged flapper 14 mounted atop chain guide 15 which has a cross-shaped opening that rotates the chain so that it aligns with the slot in the flapper 14.

During operation of the chain support, the chain 4 is pulled upward through the cross-shaped opening of the chain guide. As the chain 4 is pulled up, the flapper 14 rotates upwards when a link of the chain 4 is not aligned with the opening of the flapper 14. The flapper 14 rotates downward and around a link of the chain 4 when the link is aligned with the flapper opening. Thus the flapper 14 fits around every other chain link and acts as a ratchet. When tension on the chain 4 is released, the flapper 14 rotates downward about a link of the chain and rests on the lower end of the housing 11. The chain is now latched off and secured to the structure. By slacking off of the upward pull on the chain 4, the tension on the chain above the flapper 14 is removed and the chain 4 forms no impediment to the rotation of the housing 11 around the pair of lower trunnions 10.

In a further embodiment of the invention, the chain support includes strain gages 20 (FIG. 5) mounted to the hollow housing 11 for measuring the tension in the chain 4. Alternatively, standard resistance compression load cells (not illustrated) are placed between the flapper of the latch mechanism and the chain guide on which the flapper rests. In another embodiment, a non-contact sensor 22 (illustrated in dotted lines in FIG. 5) is positioned into the interior of the trunnion block to measure the deflection of the upper or lower trunnions. U.S. Pat. No. 6,925,890, incorporated by reference herein, illustrates the placement of a non-contact sensor on a trunnion block.

As identified in the above identification of objects of the invention, the arrangement of FIGS. 3-6 is a chain support that allows rotation about two perpendicular axes 5, 6 such that the total rotation about axis 5 is at least 90 degrees and about axis 6 is ±15 degrees. The chain support 3 of FIGS. 3-6 allows the upper end of the mooring line to be pulled up vertically through the assembly while simultaneously allowing large vertical angle variations of the lower end of the housing, while not inducting vertical or lateral misalignment of the assembly with the mooring line 4. The arrangement of FIGS. 3-6 advantageously allows adjustment of the mooring line length at any time by pulling in or letting out chain links with the capability of latching into every other chain length. Advantageously, the chain support 3 of FIGS. 3-6 has a minimal overall width.

What is claimed is:

1. A dual axis chain support (3) for connecting a mooring chain to a structure (2) comprising, an elongated housing (11) having an upper and a lower end, a trunnion block (8) having a passage (18) for a mooring chain (4), said trunnion block (8) including a first pair of trunnions (10) and a second pair of trunnions (9), said first pair of trunnions (10) defining a first pivot axis (6) that is perpendicular to the direction of said passage (18) and said second pair of trunnions (9) defining a second pivot axis (5) that is perpendicular to both said first pivot axis (6) and said passage (18), said upper end of said elongated housing (11) being pivotally connected to said first pair (10) of trunnions with the second pair (9) of trunnions being pivotally connected to said structure (2), and a latch (14) mounted to said housing (11), said latch (14) arranged and designed for ratcheting and securing said chain (4) to said housing (11) and for releasing said chain (4) from securement to said housing (11).

2. A chain support (3) for connecting a mooring chain (4) to a structure (2) comprising, an elongated hollow housing (11) having an upper end and a lower end arranged and designed to pass said chain (4) therethrough, a trunnion block (8) having a passage (18) for said mooring chain (4), a pair of upper trunnions (9), and a pair of lower trunnions (10), a clevis (12) mounted to said upper end of said housing (11), said clevis (12) pivotally connecting said trunnion block (8) to said housing (11), said pair of upper trunnions (9) defining a first pivot axis (5) that is perpendicular to the direction of said passage (18) for said mooring chain (4) and said pair of lower trunnions (10) defining a second pivot axis (6) that is perpendicular to both said first pivot axis (5) and said direction of said passage (18), a guide mouth (13) mounted to said lower end of said housing (11), said guide mouth (13) including a chain guide (15) arranged and designed to orient alternating links of said chain (4) parallel or perpendicular to said first pivot axis (5) while said chain (4) is being pulled through said guide mouth (13), and a latch mechanism (14) mounted to said housing (11) and arranged and designed for ratcheting said chain while being pulled therethrough and for latching said mooring chain after a desired tension has been achieved.

3. The chain support of claim 2 wherein, low friction, self lubricating bushings are placed between said pair of lower trunnions (10) and said clevis (12).

4. The chain support of claim 2 wherein, said pair of upper trunnions (9) are connected to said structure (2) with bearing blocks and caps, and low friction, self lubricating bushings are placed between said pair of upper trunnions and said bearing blocks and caps.

5. The chain support of claim 2 wherein, said passage (18) in said trunnion block (8) includes a guide radius (17) to guide said chain (4) during pulling of chain (4) through passage (18).

6. The chain support of claim 2 wherein, said housing (11) is fitted with strain gages (20) to measure a load exerted by said chain (4) on said structure (2).

7. The chain support of claim 2 wherein, said pair of upper trunnions (9) includes instrumentation to measure a load exerted by said chain (4) on said structure (2).

8. The chain support of claim 2 wherein, said latch mechanism (14) includes instrumentation to measure a load exerted by said chain (4) on said structure (2).

9. The chain support of claim 2, further comprising, a pipe (16) carried by said housing (11) and arranged and designed to guide a cable to actuate said latch mechanism.

* * * * *